US005408788A

United States Patent [19]

Hamilton et al.

[11] Patent Number: 5,408,788

[45] Date of Patent: Apr. 25, 1995

[54] HOLLOW HUB HELICAL EARTH ANCHOR WITH IMPROVED EARTH PENETRATING SPADE/PILOT POINT

[75] Inventors: Daniel V. Hamilton; Gary L. Seider, both of Centralia, Mo.

[73] Assignee: Hubbell Incorporated, Orange, Conn.

[21] Appl. No.: 113,411

[22] Filed: Aug. 27, 1993

[51] Int. Cl.[6] ..... E02D 5/74

[52] U.S. Cl. ..... 52/157; 405/253

[58] Field of Search ..... 52/157, 158, 160, 162, 52/163; 175/388, 394; 405/253

[56] References Cited

U.S. PATENT DOCUMENTS

| | | |
|---|---|---|
| Re. 32,076 | 2/1986 | Dziedzic . |
| 1,800,504 | 4/1931 | Chance . |
| 1,940,938 | 12/1933 | Chance . |
| 1,940,938 | 6/1930 | Chance . |
| 4,334,392 | 6/1982 | Dziedzic . |
| 4,467,575 | 8/1984 | Dziedzic . |
| 4,979,341 | 12/1990 | Norman et al. . |
| 4,981,000 | 1/1991 | Hamilton et al. . |
| 4,996,806 | 3/1991 | Platz . |

*Primary Examiner*—Carl O. Friedmann
*Assistant Examiner*—Creishton Smith

[57] ABSTRACT

A lighter weight, high strength cast screw anchor is disclosed which has a hollow, installation wrench receiving hub, a helical, load bearing element projecting outwardly from the hub, and an elongated, pointed end spade integral with and extending away from the hub. The spade has two diametrically opposed, angularly disposed cutting margins located on opposite sides of the axis of the hub. The tip section of the pointed spade is offset laterally from the hub axis, so that upon installation of the anchor, the hub and helical load bearing element move in an orbital path about the axis of the tip, whereas the spade moves in an orbital path after the helical element has been installed in the ground to a depth limiting its orbital movement. The resulting anchor may be installed in dense or frozen soils with less torque and to a greater depth than heretofore available cast screw anchors.

18 Claims, 5 Drawing Sheets

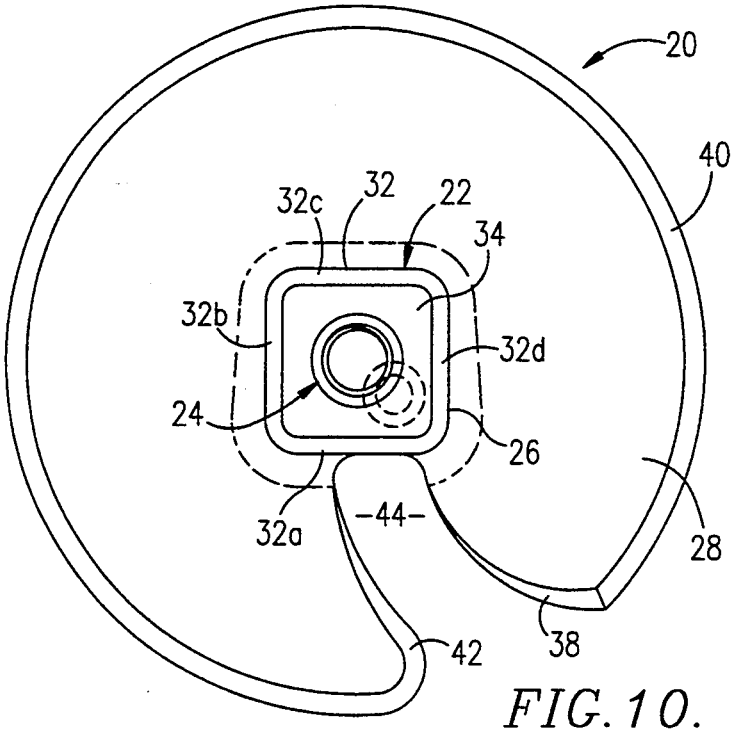
FIG. 10.
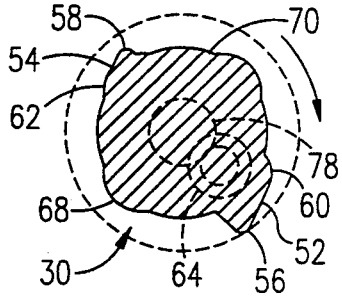
FIG. 11.
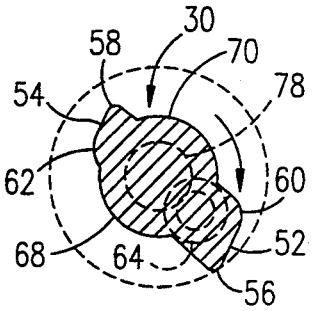
FIG. 12.
FIG. 14.
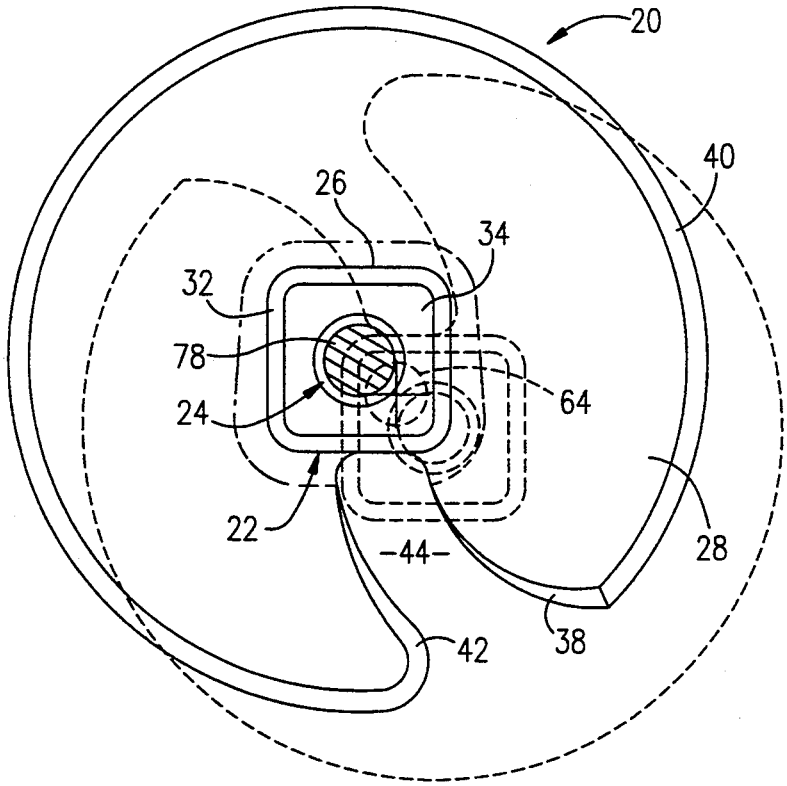
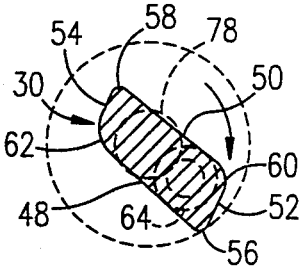
FIG. 13.
FIG. 15.
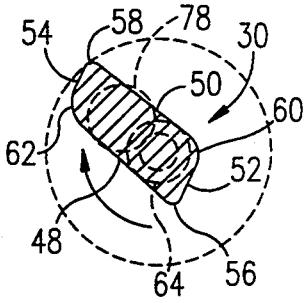

TORQUE AND DEPTH COMPARISON TEST

HOLLOW HUB HELICAL EARTH ANCHOR WITH IMPROVED EARTH PENETRATING SPADE/PILOT POINT

BACKGROUND OF THE INVENTION

1. Field of the Invention

The present invention relates generally to earth anchors, and more particularly, to a cast screw anchor which is of lighter weight and equal strength to previous cast anchors, and may be installed with less torque to a greater depth in dense or frozen soils than has heretofore been the case.

2. Description of the Prior Art

U.S. Pat. No. 4,981,000, assigned to the assignee hereof, illustrates and describes a cast anchor which provided for improved penetration in frozen, stony or dense soils. Although the cast anchor of the '000 patent was an improvement over other previously available screw anchors, such as those shown in the assignee's U.S. Pat. Nos. 4,334,392 and 4,467,575 for the reasons explained in the '000 patent, it was found that under certain difficult soil conditions, the torque required to install the cast anchors was greater than desirable, and the anchor could not be installed to a requisite depth without exceeding the torque capacity available.

SUMMARY OF THE INVENTION

It is an object of the present invention to provide an improved cast anchor of lighter weight than the cast anchor of the '000 patent, but of equal strength to the latter, and that can be installed to a greater depth with less torque in soils of similar density.

The improved cast screw anchor hereof has a hub for reception of an internal drive installation wrench, and an elongated spade portion integral with and extending from the hub in a direction away from the open, wrench receiving end of the latter, that is constructed to not only provide for decreased overall weight, but also enhance initial penetration of the anchor in dense and frozen soils, while at the same time being installable with less torque to a greater depth than heretofore possible.

The present cast anchor exhibits improved penetration and has a lower installation torque requirement by virtue of the fact that the spade portion of the anchor integral with the hub thereof is of minimal cross sectional area without sacrifice in strength, has diametrically opposed, angularly oriented cutting edges, and terminates in an offset relatively pointed tip whereby the hub and helix initially move in an orbital path relative to the tip to improve the angle of attack of the helix with the ground upon initial entry of the helix into the soil, and the spade portion thereafter moves in its own orbital path to shift soil laterally as the anchor advances.

The torque required to install the present anchor as compared with the prior cast anchor is also less because of the provision of novel tapered transition sections which extend from the main body of the spade portion of the anchor and blend into the polygonal hub thereof, thereby decreasing the installation resistance of the anchor within dense soil structures.

BRIEF DESCRIPTION OF THE DRAWINGS

FIG. 10 is a plan view of the anchor;

FIGS. 11–13 are horizontal cross sectional views taken on the lines 11—11, 12—12 and 13—13 respectively of FIG. 2;

FIG. 14 is a plan view similar to FIG. 13 but illustrates the orbital path of the helix and hub during initial installation of the anchor;

FIG. 15 is a cross sectional view through the anchor of FIG. 14 and taken on the same sectional line as FIG. 13—13 of FIG. 2.

DETAILED DESCRIPTION OF THE PREFERRED EMBODIMENTS

Figure 1:
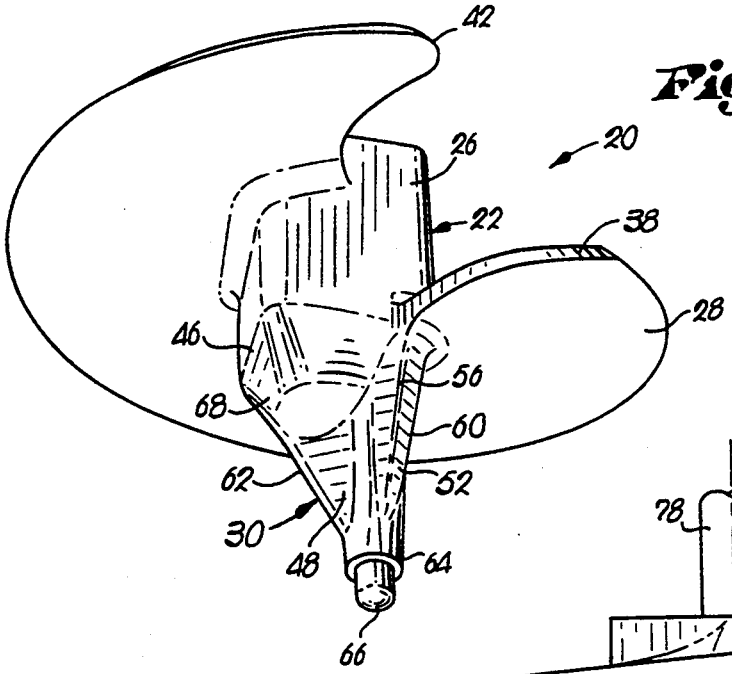
FIG. 1 is a perspective view from one side of a cast anchor embodying the preferred concepts of the present invention.

A cast screw anchor embodying the preferred principles of this invention is broadly designated by the numeral 20 in the drawings. Anchor 20 comprises a one piece monolithic body 22 cast about a rod connector 24. The main component parts of anchor body 22 include a transversely square hub 26, a helical element 28 joined to hub 26, and a spade portion 30 projecting from the lower end of the hub 26.

Figure 9:
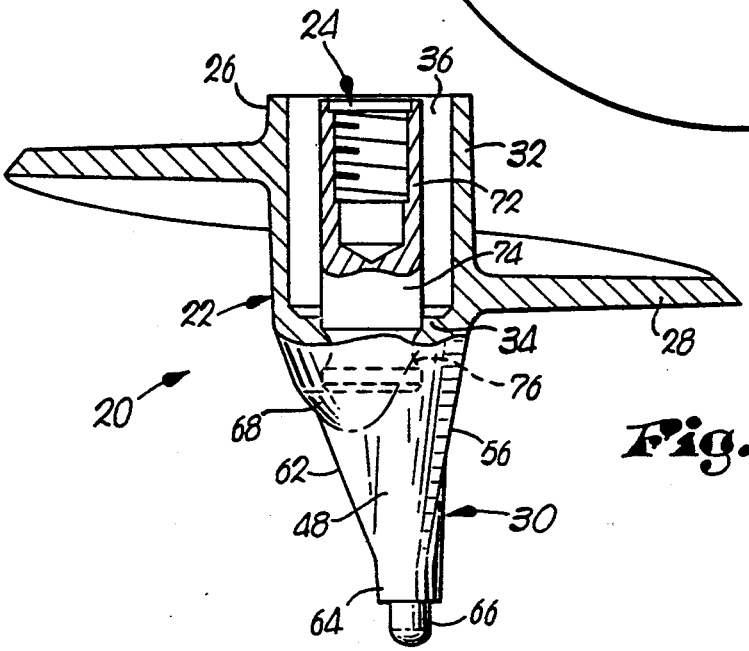
FIG. 9 is a view similar to FIG. 6 with a portion thereof being broken away to reveal details of the internal construction of the anchor.

As is most evident from FIGS. 9 and 10, the hub 26 is of hollow configuration and made up of a square sidewall 32 having side portions **32*a*, 32*b*, 32*c* and 32*d* respectively. The upper end of the hub 26 is open whereas the opposite extremity thereof is closed with a bottom portion 34. Although hub 26 is depicted as being of transversely square configuration, it is to be appreciated that the hub may be of different shapes with the principle requirement being that the cavity 36** presented thereby be of polygonal shape for reception of a complementally configured external drive tubular wrench.

The helical element 28 which is cast in place with the sidewall 32 of hub 26 projects radially outwardly therefrom to an extent that is a function of the desired holding capacity of the particular anchor. Typical helix diameters range from about 8 inches to about 14 inches.

It is to be observed that the leading edge 38 of helical element 28 is beveled and of longitudinally curvilinear shape with the angled surface of such edge facing upwardly. It is also desirable that edge 38 be of longitudinally helical configuration as is most evident from FIG. 10, with the angularity of such curvilinear edge increasing as the outer margin 40 of helical element 28 is approached. It is also preferred that margin 40 be beveled in the same direction as beveled edge 38 so that the angled surfaces thereof all face upwardly. Viewing FIG. 10, it is to be seen that the trailing edge 42 of helical element 28 is likewise beveled to present an upwardly facing surface and that edge 42 is also longitudinally helical with the angle thereof increasing as the outer beveled margin 40 is approached. The leading and trailing edges 38 and 42 respectively do not overlap longitudinally of the anchor thereby present a gap 44 therebetween which allows objects such as small rocks and the like to pass therebetween. In a preferred form of anchor 20, the curvilinear leading and trailing edges 38 and 42 have a common center point. From FIG. 2 it can be seen that the trailing edge 42 of helical element 28 joins with the hub 26 adjacent the open end thereof, while the leading edge 38 of the helical element connects to the hub in proximal relationship to bottom 34.

The spade portion 30 of anchor 20 has a body section 46 which is integral with and extends downwardly of the bottom portion 34 of hub 26. Main body section 46 generally defines a parallelepiped having a pair of opposed main surfaces 48 and 50 which are generally parallel with one another, and a pair of opposed secondary end surfaces 52 and 54 respectively.

The elongated margin 56 defining the zone of merger between secondary surface 52 and main surface 48 presents a front angular cutting edge. The elongated margin 58 defining the zone of merger between secondary surface 54 and main surface 50 defines a rear angular cutting edge which is diametrically opposed to the cutting edge presented by margin 56.

Similarly, the elongated margin 60 between secondary surface 52 and main surface 50 presents a trailing edge which is diametrically opposed to a trailing edge defined by the elongated margin 62 between secondary surface 54 and main surface 48. In a preferred embodiment secondary surfaces 52 and 54 are at an acute relief angle transversely thereof of about 70° to 80°.

It can also be seen from the drawings that the secondary surfaces 52 and 54 are oriented such that the cutting margins 56 and 58 defined thereby are at an angle with respect to the longitudinal axis of hub 26. Furthermore, the angularity of margin 56 with respect to the axis of hub 26 is different than the angularity of margin 58 relative to such axis.

The main surfaces 48 and 50 and secondary surfaces 52 and 54 terminate in a tip section 64 which is of generally cylindrical configuration. A tip member 66 projects outwardly from tip section 64 and is of reduced cross sectional area relative to the section 64.

A pair of opposed tapered sections 68 and 70 which are of semi-conical configuration in the preferred embodiment, and extend upwardly from main surfaces 48 and 50 respectively, and merge smoothly with the side portions 32*a–d* inclusive of hub 26. The tapered sections reduce the frictional surface area of spade portion 30 as the screw anchor 20 is installed to decrease the installation torque requirements for the anchor. It is particularly noteworthy that the tapered sections 68 and 70 merge smoothly into the outer surfaces of side portions 32*a–d* of hub 26.

As best shown in FIG. 9, the bottom 34 of hub 26, and the tapered sections 68 and 70, as well as the upper part of spade portion 30 present a body which receives the cylindrical, internally threaded connector 24. In the embodiment of anchor 20 shown, connector 24 comprises a separate insert having a cylindrical wall 72 and a cylindrical end 74 provided with an inwardly directed shear groove 76. The cylindrical wall 72 of connector 24 is internally threaded to complementally receive the external threads of a conventional elongated connector rod 78 adapted to be connected to anchor 20. Although in the preferred embodiment of anchor 20, connector 24 is separate from body 22, it is to be understood that such connector may be cast integrally with body 22 in the fabrication process. A further note is a fact that connector 24 should be of a diameter such that a space is presented between the outer surface of the cylindrical wall 72 of connector 24, and the interface of side wall 32 presenting cavity 36, to receive the drive end of a conventional tubular installation wrench (not shown).

Figure 2:
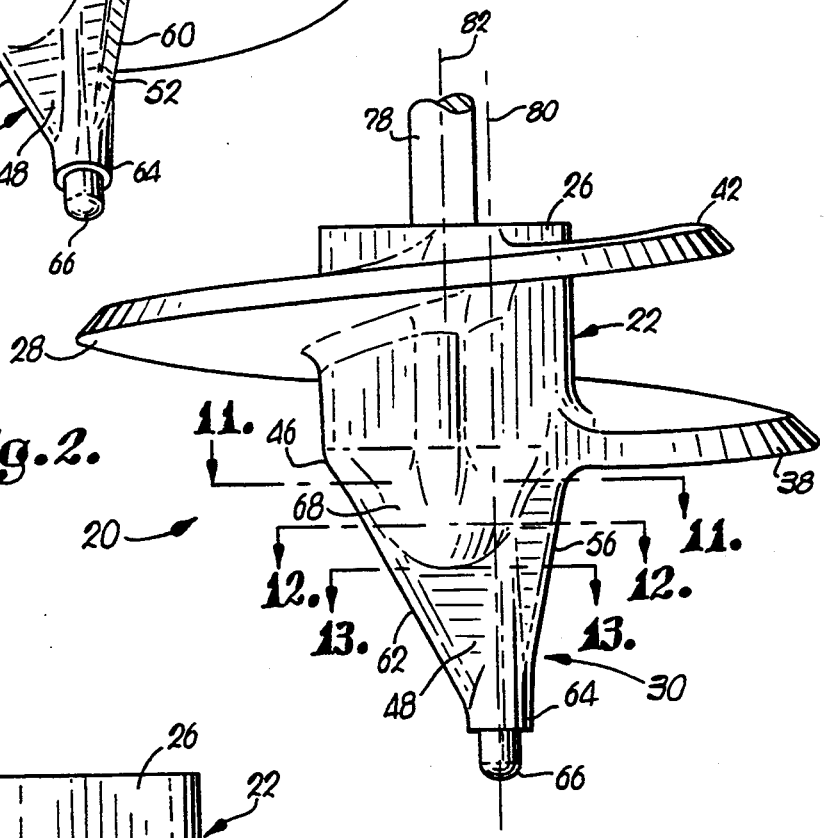
FIG. 2 is another perspective view of the anchor illustrated in FIG. 1.
Figure 3:
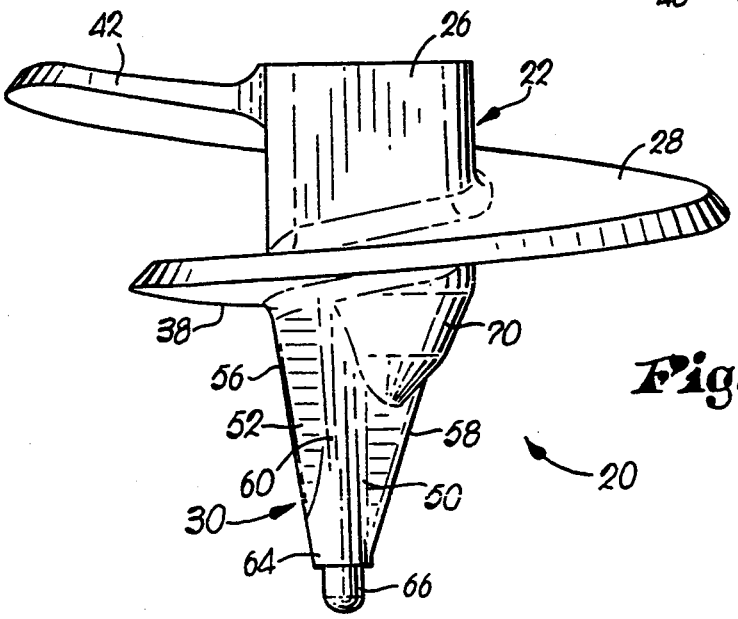
FIG. 3 is an elevational view of one side of the anchor of FIG. 1.
Figure 4:
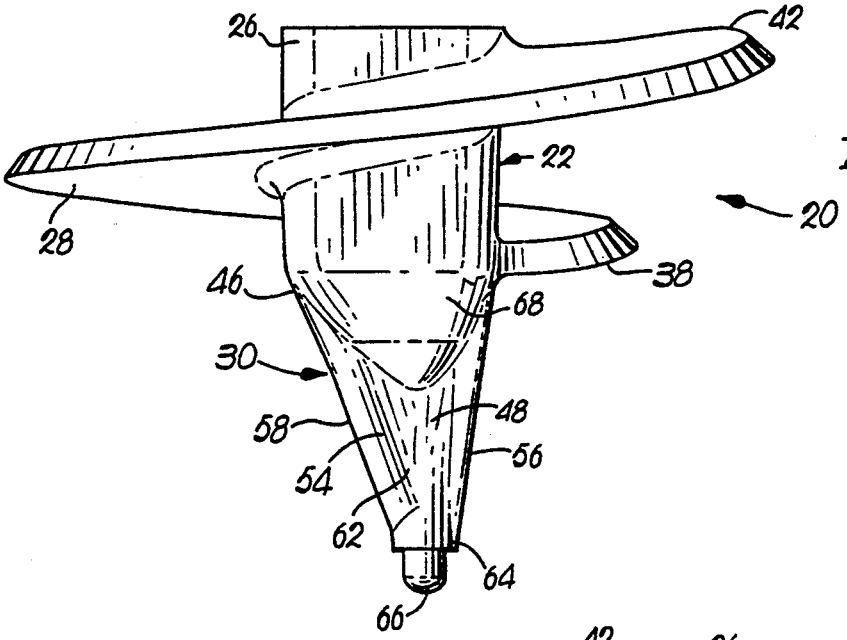
FIG. 4 is an elevational view of another side of the anchor of FIG. 1.
Figure 5:
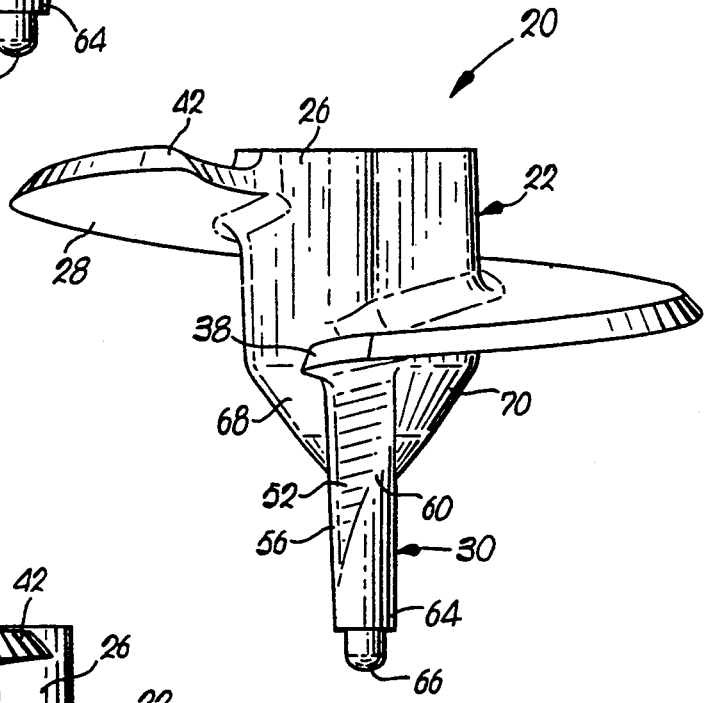
FIG. 5 is a third perspective view of the anchor of FIG. 1 which has been rotated 135° in a clockwise direction from the view in FIG. 4.
Figure 6:
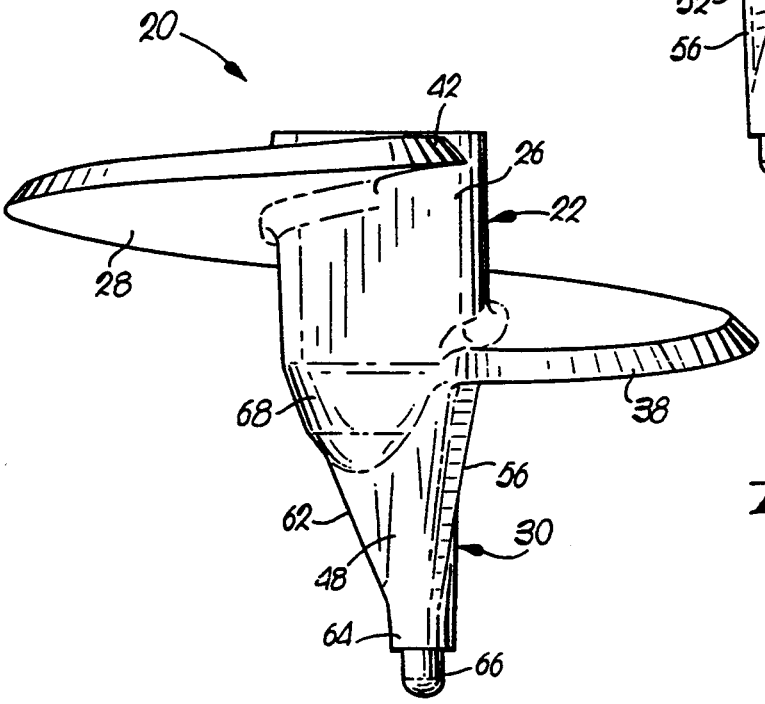
FIG. 6 is an elevational view of the third side of the anchor of FIG. 1.
Figure 7:
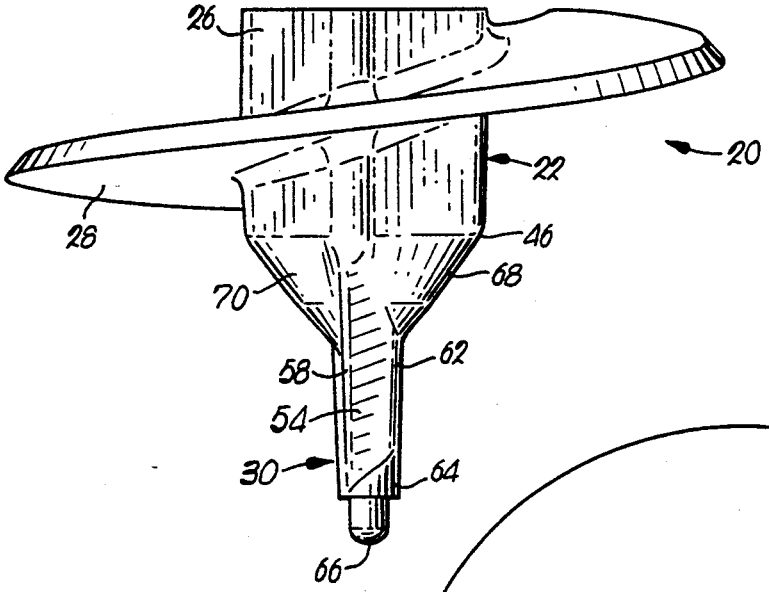
FIG. 7 is another perspective view of the anchor of FIG. 1.
Figure 8:
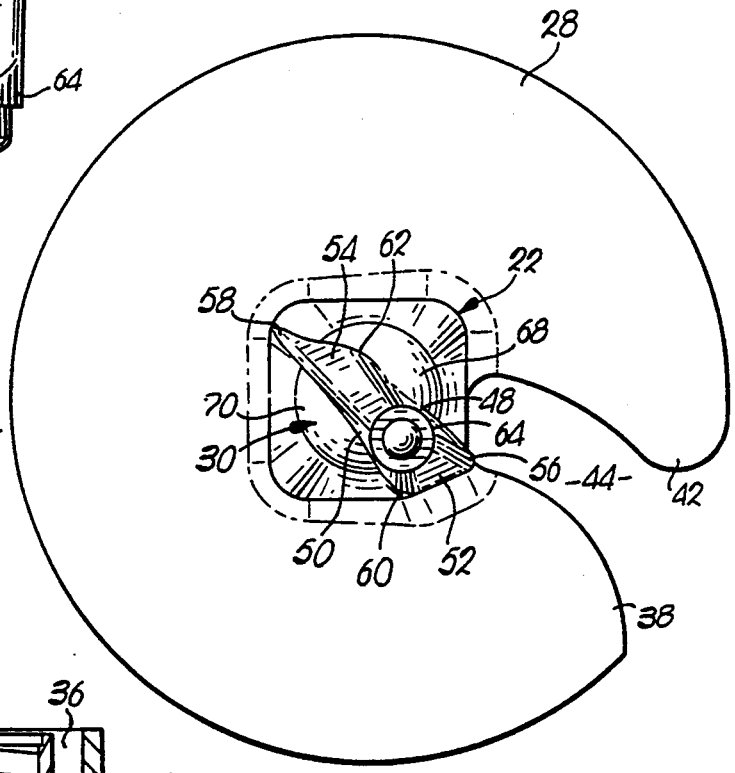
FIG. 8 is an end view of the anchor.

The axis 80 of tip section 64 is offset from the axis 82 of hub 26 as is most evident from FIG. 2. Thus, the angularity of margin 56 with respect to axis 80 in the preferred embodiment of anchor 20 is about 10°, while the angle of margin 58 is about 30°. In this preferred embodiment, the overall length of spade portion 30 excluding tip member 66 is preferably greater than the maximum transverse dimension of hub 26. The length of spade portion 30 in this respect is established by the distance between the lowermost margin of beveled edge 38 where is joins spade portion 30 and the bottom of the spade portion excluding member 66. In a typical 10 inch diameter helix, the maximum external dimension of hub 26 is from about 2¾ to about 3 inches and the defined spade portion (excluding tip 66) has a length of at least about 4 inches. The distance from the lower extremity of spade portion 30 (minus tip member 66) to the lowermost ends of tapered transition sections 68 and 70 nominally is about 2½ inches. The diameter of cylindrical tip section 64 is about 1 inch, and tip member 66 is about 5/8 inch in diameter.

Installation Of Anchor 20

Anchor 20 may be installed in the ground at any desired angle from about vertical to as much as 80+°. After securement of rod 78 to connector 24, a tubular wrench is telescoped over rod 78 in disposition with the drive end thereof received in cavity 36 of hub 26. An exemplary wrench is shown for example in the assignee's U.S. Pat. No. Re. 32,076. The wrench is then connected to the kelly bar of a drive motor mounted on a digger-derrick unit or similar machine. Down pressure is placed on the anchor 20 resting on the ground at the desired angle as anchor rotation is initiated. The relatively pointed shape of spade portion 30 presented by tip section 64 (and tip member 66 if present) allows the operator to relatively precisely position anchor 20 at the exact point where it is desired to drive the anchor into the ground.

This precise positioning is especially important in relatively dense or frozen soils, where walking of the anchor on the surface of the ground might otherwise occur. Furthermore, the generally tapered shape of spade portion 30, the extended length thereof, and the angularity of the cutting edges defined by margins 56 and 58 of portion 30, allows the operator to install anchor 20 at significant angles with respect to the vertical without danger of walking. The shape and length of spade portion 30 prevents the outer margin of the helical element 28 from engaging the ground during initial rotation of the anchor which would contribute to the tendency of the anchor to walk on the surface before it penetrates the soil to a depth to preclude such lateral movement.

FIGS. 14 and 15 illustrate the orbital movement of anchor 20 during initial installation and before the helical element 28 has been driven into the ground to a depth such that the orbital action can no longer occur. This eccentric movement of the helix and hub contributes to improved initial anchor penetration by virtue of the fact that the cutting margins 56 and 58 on opposite sides of spade portion 30 move the soil laterally so that the spade portion may be driven into the ground with the down force on the anchor, even in very dense clay, shale, rocky and frozen ground.

The orbital action of helical element 28 and the hub 26, results in the beveled leading edge 38 of helical element 28 being presented to the soil when it first engages the ground at an advantageous angle of attack. The beveled leading edge 38 not only moves downwardly but also laterally as it engages the ground producing a slicing action for improved initial penetration.

The angularity of cutting margins 56 and 58 with respect to axes 80 and 82 improves the initial penetrability of anchor 20 into the ground, even under difficult soil conditions because of the progressively increasing cutting action and lateral soil movement by spade portion 30 as it is forced downwardly into the ground. The relief provided by secondary surfaces 52 and 54 also improves the functionality of cutting margins 56 and 58.

When the tapered sections 68 and 70 of spade portion 30 engage the surface of the ground, the conical configuration thereof minimizes resistance to rotation offered by the soil and provides a smooth transition as the hub 26 is brought into contact with the soil. These transition areas continue to minimize frictional resistance that would otherwise be present as the hub, which is of polygonal configuration, is driven deeper and deeper into the ground.

The curvilinear beveled leading edge of helical element 28 is also of helical configuration longitudinally thereof as previously described, which again adds to the improved initial penetrability of the helix by slicing rather than pushing through the soil, and has a camming action to displace small rocks and the like which would impede rotation of the helical element 28. The non-overlapping relationship of leading edge 38 and trailing edge 42 also allows such rocks to pass therebetween and prevent closing up the pitch opening of the helix.

After anchor 20 has been driven into the soil to a depth such that the resistance of the ground is sufficiently great to prevent helical element 28 and hub 26 to continue their orbital movement (generally within 2 feet), the spade portion 30 then starts to orbit about axis 82 as is shown by FIG. 10–13 inclusive. From FIGS. 11–13, it can be seen that the cutting margins 56 and 58 move in an orbital path about the axis 82 of hub 26 and thereby displace soil laterally to an extent that is equivalent to the maximum cross sectional dimension of the hub thereby decreasing the force required for the hub to be driven into the ground by the helical element 28.

Example

A test was conducted to compare the installation torque requirements and depth of which anchors can be driven using a 10 inch diameter helix anchor as depicted in U.S. Pat. No. 4,981,000, and a 10 inch diameter helix anchor 20 as described and illustrated herein. Each anchor was installed three times in dense fire clay on the premises of the A. P. Green Refractories (a fire brick company), approximately 10 miles north of Mexico, Mo. The clay was too dense to probe with the assignee's standard soil testing device.

The anchors were installed using an Altec D1000 digger-derrick having a hydraulic drive motor rated at 20,000 foot lbs. of torque. Maximum available down pressure at the boom length setting of from about 5,000–6,000 lbs. was applied to the anchors during each installation.

Figure 16:
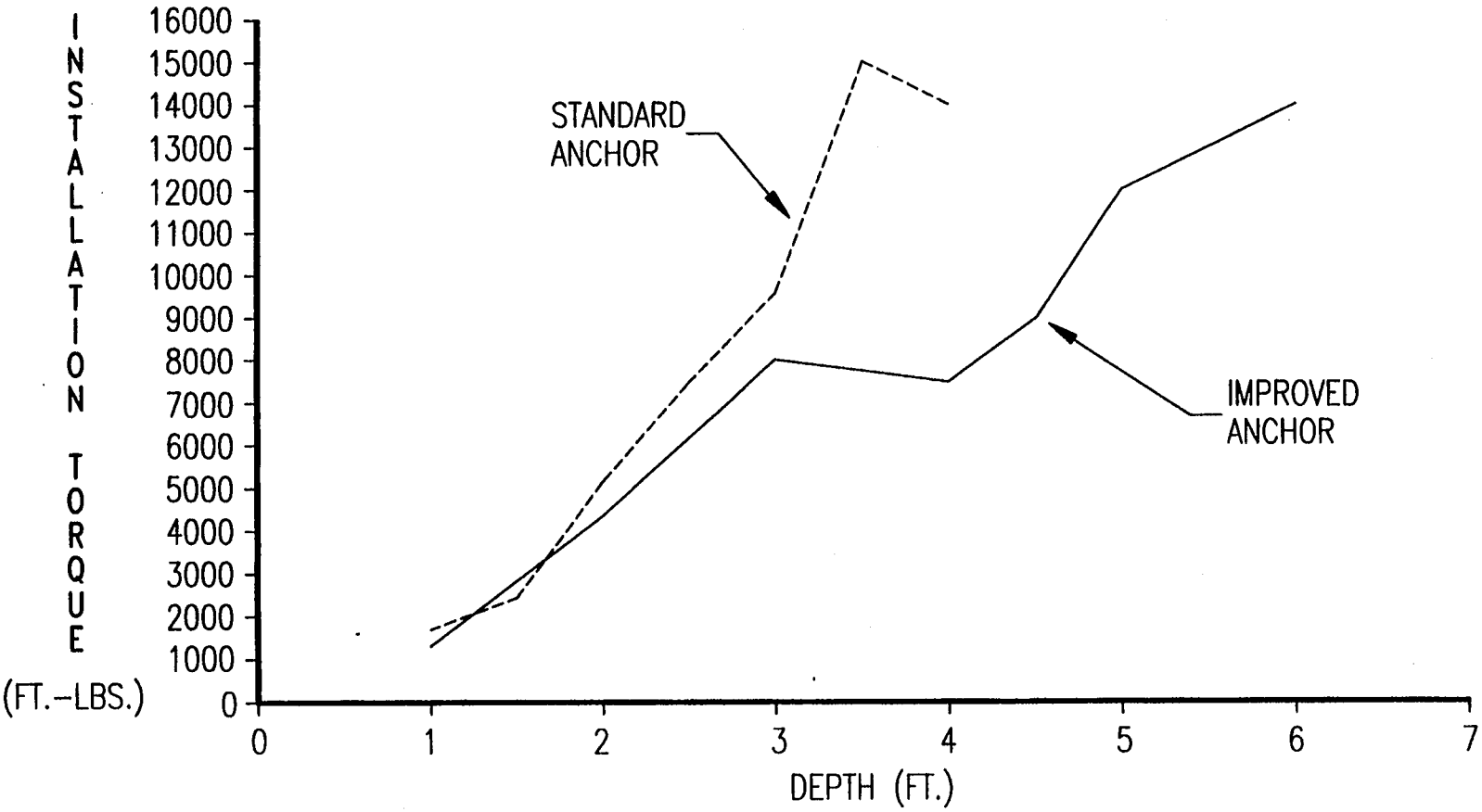
FIG. 16 is a graphical representation of test data depicting the results of a comparative test of torque and penetration depth between the anchor of the '000 patent and the anchor of FIG. 1 in the same type of soil.

FIG. 16 depicts the results of the comparative tests with the 10 inch diameter anchor of the '000 patent being identified as the "Standard Anchor" whereas the anchor identified herein by the numeral 20 and of the dimensions described, being designated as the "Improved Anchor". It can be seen from FIG. 16 that anchor 20 not only was installed at less torque but was driven to significantly deeper levels at the same torque levels. In fact, the "Standard Anchor" could not be installed to more than about 4 feet even with 14,000+ foot lbs. of torque applied.

We claim:

1. A cast screw anchor adapted to be installed with a tubular wrench having a transversely polygonal external anchor engaging drive end, said anchor comprising:

a hollow, elongated, longitudinally extending, open-ended hub having a longitudinal axis, a longitudinal length along said axis, an extremity opposed to the open end of the hub, and a transversely polygonal cavity configured to complementally receive said drive end of the wrench;

a radially extending, generally helical load bearing element integral with the hub and projecting outwardly from the axis of the hub, said element being provided with a leading edge and a trailing edge intersecting the hub in spaced relationship along said longitudinal length of the hub;

an elongated spade portion integral with the hub, having a body section extending from said extremity of the hub opposed to said open end thereof, and provided with an outer tip section, said spade portion having a pair of opposed main surfaces spaced a distance apart and a pair of opposed secondary surfaces spaced a distance apart, the distance between said secondary surfaces increasing to a greater extent than the distance between the main surfaces as the hub of the anchor is approached in a direction away from said outer tip section of the spade portion, said main surfaces and the secondary surfaces merging to define margins extending longitudinally of the spade portion, there being two diagonally opposed first margins which define cutting edges and two diagonally opposed second margins, the transverse angle between each main surface and a corresponding secondary surface which defines a respective cutting edge therebetween being less than a right angle; and a pair of opposed, generally tapered transition sections extending from the main surfaces and blending into the extremity of the hub opposed to said open end thereof, said secondary surfaces defined by respective adjacent first and second margins being at an angle relative to the longitudinal axis of the hub and converge in the direction of the tip section.

2. A cast screw anchor as set forth in claim 1, wherein the angle of one of said pair of secondary surfaces with respect to the longitudinal axis of the hub is different than the angle of the other secondary surface with respect to the longitudinal axis of the hub section to cause the tip section to be offset from said hub axis.

3. A cast screw anchor as set forth in claim 1, wherein said spade portion is of generally parallele-piped configuration transversely thereof.

4. A cast screw anchor as set forth in claim 1, wherein said transition sections are of generally conical configuration.

5. A cast screw anchor as set forth in claim 1, wherein the spade portion is of a length at least about equal to the largest cross sectional dimension of the hub.

6. A cast screw anchor as set forth in claim 1, wherein said leading edge of the helical load bearing element is beveled to present a sharpened helix leading edge.

7. A cast screw anchor as set forth in claim 1, wherein said helical element has an outermost edge, said outermost edge of the helical element being beveled.

8. A cast screw anchor as set forth in claim 2, wherein the secondary surface in closest proximity to the leading edge of the helical element is at an angle relative to the longitudinal axis of the hub which is less than the angle of the other secondary surface with respect to said longitudinal hub axis.

9. A cast screw anchor as set forth in claim 8, wherein said secondary surface in closest proximity to the leading edge of the helical element is disposed such that the margin presenting said cutting edge thereof is generally aligned with said leading edge.

10. A cast screw anchor as set forth in claim 1, wherein said hub is transversely square and thereby has a pair of diagonally opposed corners, and the leading edge of the helical element joins with the hub at one of the corners of said diagonal pair thereof, said spade portion being oriented such that the main surfaces thereof extend in a direction between said one corner of the hub and said diagonally opposed corner thereof.

11. A cast screw anchor as set forth in claim 1, wherein said secondary surface remote from the leading edge of the helical element has a length which extends to and joins with said extremity of the hub in greatest spaced relationship from the open end of the hub.

12. A cast screw anchor as set forth in claim 11, wherein said tapered sections merge with said one secondary surface adjacent the hub.

13. A cast screw anchor as set forth in claim 1, wherein said tip section includes an outermost member of less cross sectional area than the portion of the tip section next adjacent to said member.

14. A cast screw anchor as set forth in claim 1, wherein said hub is provided with internal walls defining said polygonal cavity, and wherein is included a threaded component within said hub, spaced from the internal walls thereof, and coaxial with the longitudinal axis of the hub for receiving an elongated threaded connector rod.

15. A cast screw anchor as set forth in claim 1, wherein said leading edge of the helical element joins with the hub at a point generally aligned with said extremity of the hub remote from said open end of the hub.

16. A cast screw anchor as set forth in claim 15, wherein said trailing edge of the helical element joins with the hub at a point generally aligned with the open end of the hub.

17. A cast screw anchor as set forth in claim 1, wherein said leading and trailing edges of the helical element are of curvilinear configuration, have a common center point, and do not overlap in a direction longitudinally of the hub.

18. A cast screw anchor as set forth in claim 1, wherein said leading edge is of beveled, generally helical configuration along the length thereof.

* * * * *